US006282488B1

(12) United States Patent
Castor et al.

(10) Patent No.: US 6,282,488 B1
(45) Date of Patent: Aug. 28, 2001

(54) AIRPORT SURFACE MOVEMENT GUIDANCE AND CONTROL SYSTEM

(75) Inventors: Robert Castor, Unterschleissheim (DE); Lothar Belger, Everberg; Andre Jelu, Tienen, both of (BE); Per Ingar Skaar, Oslo (NO); Einar Henriksen, Sandefjord (NO); Fredrik Berg-Nielsen, Stabekk (NO)

(73) Assignees: Siemens Aktiengesellschaft, Munich (DE); Oslo Lufthaven AS, Gardermoen (NO)

( * ) Notice: Subject to any disclaimer, the term of this patent is extended or adjusted under 35 U.S.C. 154(b) by 0 days.

(21) Appl. No.: 09/144,326

(22) Filed: Aug. 31, 1998

Related U.S. Application Data

(63) Continuation of application No. PCT/EP97/00984, filed on Feb. 28, 1997.

(30) Foreign Application Priority Data

Feb. 29, 1996 (DE) ..... 196 07 734
Feb. 29, 1996 (DE) ..... 196 07 720
Feb. 29, 1996 (DE) ..... 196 07 727

(51) Int. Cl.[7] ..... G08G 5/06

(52) U.S. Cl. ..... 701/120; 701/17; 244/114 R; 340/948

(58) Field of Search ..... 701/120, 3, 14, 701/15, 16, 17, 18; 244/315, 159, 160, 161, 114 R; 340/947, 948, 951, 952, 953, 954, 956, 957, 958, 971, 972, 981, 982; 348/113, 117, 143, 149

(56) References Cited

U.S. PATENT DOCUMENTS 3,706,969 * 12/1972 Paredes ..... 340/23
3,971,025 * 7/1976 Levine ..... 343/108 R
4,184,655 * 1/1980 Anderberg ..... 244/114 R
4,733,833 * 3/1988 Shepherd ..... 244/114 R
5,268,698 * 12/1993 Smith, Sr. et al. ..... 342/450
5,334,982 * 8/1994 Owen ..... 342/36
5,426,429 * 6/1995 Norman et al. ..... 340/953
5,519,618 * 5/1996 Kastner et al. ..... 701/120
5,659,475 * 8/1997 Brown ..... 701/120
5,719,567 * 2/1998 Norris ..... 340/953
5,877,721 * 3/1999 Tsang et al. ..... 342/36
5,999,116 * 12/1999 Evers ..... 342/36
6,023,665 * 2/2000 Millgard ..... 702/151
6,047,233 * 4/2000 Salvatore, Jr. et al. ..... 701/120

FOREIGN PATENT DOCUMENTS 4406821 9/1995 (DE) .

OTHER PUBLICATIONS

Monzel et al., "Surface Movement Guidance and Control System," *Electrical Communication*, 1st Quarter 1993, pp. 51–59.
"Brite II," Airfield Lighting New Products brochure, 26–29 Sep. 1995, 4pgs.
"Jane's Airport Review" Sep. 1995, vol. 7, No. 7, p. 46.
TECOS Terminal Coordination System, Indent. Nr. 02963.0, Siemens AG, Feb. 1996.

* cited by examiner

*Primary Examiner*—Tan Nguyen
(74) *Attorney, Agent, or Firm*—Sughrue, Mion, Zinn, Macpeak & Seas, PLLC

(57) ABSTRACT

An airport surface movement guidance and control system (SMGCS) involving detection, integrated processing and graphical display of the relevant, in particular the safety-relevant, positions and movements of aircraft, and optionally, vehicles, on airside (runway, taxiways, apron) and in the relevant airport airspace. At least one radar detects the positions and movements between airborne and parked positions of the aircraft. The relevant data are displayed after data concentration on the monitor of at least one controller station in graphical form and/or letter or number form. As a result, the operational management of the surface movement can be planned and executed from the at least one controller station by means of solely the SMGC system.

43 Claims, 5 Drawing Sheets

AIRPORT SURFACE MOVEMENT GUIDANCE AND CONTROL SYSTEM

This is a Continuation of International Application PCT/EP97/00984, with an international filing date of Feb. 28, 1997, the disclosure of which is incorporated into this application by reference. International Application PCT/EP97/00984, in turn, claims priority from German Application Nos. 19607734.6, 19607720.6 and 19607727.3, filed on Feb. 29, 1996, the disclosures of which are also incorporated into this application by reference.

FIELD OF AND BACKGROUND OF THE INVENTION

The invention relates to new and useful improvements to an airport guidance system, and in particular to an airport surface movement guidance and control system (SMGCS).

Airport surface movement guidance and control systems have been described, for example, in the document BRITE II from N.V. ADB S.A., Zaventem, Brussels AP.01.810e, Special Issue for the Inter Airport 1995 Exhibition, which is incorporated herein by reference.

OBJECTS OF THE INVENTION

One object of the invention is to refine the system described there, which uses sensors arranged on the ground, to optimize the control of airport traffic, with the airport take-off and landing capacity being increased, and with maximum possible safety, in all types of weather. It is a further object to allow the tower personnel to be employed as flexibly as possible.

SUMMARY OF THE INVENTION

These and other objects are achieved by the teaching of the independent claims. Particularly advantageous refinements of the invention are the subject matter of the dependent claims. An SMGCS according to the invention uses at least one radar and a processing system to provide detection, integrated processing and graphical displays showing the positions and movements of aircraft, and possibly vehicles on the airside grounds (runways, taxiways, aprons, ramps, etc.) and in the airport airspace control zone (CTR) with particular regard to safety. The system is intended to discriminate between air movement and stationary objects in a parked position. The data are displayed in concentrated form, graphically or alphanumerically, on at least one controller's monitor. In this way, the system is able to provide operational management of surface movements both by planning them in advance and controlling them as they happen. This system covers all movements required to control surface traffic and provides an integrated control and guidance system for airports allowing traffic movements to be optimized with maximum possible safety, thus avoiding collisions on the ground and in the approach (landing) and departure (take-off) areas.

In flight, ground navigation aids protect aircraft against collisions. Non-visual and visual approach aids also help the aircraft to maintain the required glidepath during final approach. The riskiest part of an aircraft's journey, however, is on the ground, after touchdown. This is where most accidents happen. The surface movement guidance and control system (SMGCS) of the invention provides another major aid in this regard, so that monitoring, guidance and control can be carried out uninterruptedly. These types of systems are also called advanced (A)SMGCS, but have thus far not been feasible. The invention allows this to be done for the first time.

The invention also covers the detection and operational management of vehicle movements on the airside grounds, for example using transponder interrogations and squawks (squitters) or via ID tags and radios, which can also be used to transmit instructions. Ground traffic, which up to now has remained largely unmonitored, especially in the apron and ramp areas, has been a major source of accidents. Accordingly, the invention provides a major safety improvement. The system also allows airborne movements in the approach and departure areas to be covered by the monitoring and operational management components of the system. This optimizes surface movement planning. The early identification of discrepancies between the present traffic situation and the planned situation also improves safety, for example if a taxiway is still in use when it should be clear.

A major safety factor is the joint use of at least one primary radar and at least one secondary radar. The primary radar is used to locate objects on airside, while the secondary radar uses transponders for identification in the landing approach and take-off departure areas. According to the invention, identification on the ground is accomplished for incoming craft by means of a handover from the approach radar (secondary radar) during ongoing traffic. Conversely, responsibility is taken over from the docking guidance system in the case of outgoing craft, and identification is maintained by tracking targets through the primary radar. Safety and reliability are further improved by detecting squawks from transponders fitted to aircraft and to ground vehicles. Exact positions are determined, with simultaneous identification, by comparing signal arrival times (multilateration). Redundant and continuous identification of aircraft, and optionally also vehicles, in an airport movement area can thus be carried by the inventive system.

The system according to the invention also has a taxiing planning component which allows the controller to propose taxi routes, with the system automatically checking that there is no collision risk. The planning component and the collision risk check are carried out by permanently installed software that incorporates the appropriate safety features and algorithms. For instance, these algorithms ensure compliance with minimum separation regulations required under different weather conditions. The software algorithms additionally reflect intermediate aircraft stop positions, guaranteeing collision avoidance in the ramp area (apron) as well. Preferably, these software algorithms are based on aircraft flight plans. This is done because, at least at large airports, take-off and landing movements, as well as gate occupancy, are planned well in advance based on flight plans.

It is contemplated that the airport surface movement guidance and control system processes the data via an essentially conventional video subsystem and outputs the necessary displays on one monitor for the controller to see. Such radar video subsystems are marketed, for example, by HITT, one example thereof being described in "Jane's Airport Review, Sept. 1995, Volume 7, Issue 7, page 46".

A display according to the invention and based on the BRITE II system, when produced on the radar video, exhibits a greater data concentration and more details than would be available by combining the conventional BRITE II system with the known HITT radar video. This is a major objective of the invention.

It is an advantage that the displays on the monitor, for example, fashioned as a real-time radar video, as a synthesized radar display and/or as a synthesized display of the traffic routes and patterns at the airport, can be concentrated on a monitor. The display can further be provided with windows for status displays, handover lines and acknowledgement lines, etc., as well as indicate the switching states of the taxiway lighting sections, the stop bars, etc. The type and extent of concentration preferably varies in relation to the amount of airport traffic. Thus, for example, if only one control station need be occupied at night, the system concentrates the relevant display data on a single monitor. As other control stations are added in the morning, when the traffic volume increases, the system reallocates the display data accordingly. This allows responsibility to be split between individual controllers in the tower, as appropriate.

According to a further advantageous refinement of the invention, responsibility is handed over between control personnel after a handshake protocol in the monitor window display or on auxiliary monitors. This allows the workstations to be allocated and shifted without impairing safety. It is an advantage here that the sequences correspond to the sequences known and used for stripless tower organization. The document TECOS Terminal Coordination System, Ident. No. 02963.0, published by Siemens in 1996 and incorporated herein by reference, shows an example of this.

The sequences described above can be implemented particularly advantageously by using a large flat screen to display the individual windows, the radar video, etc. Most preferably, the flat screen is embodied as a touchscreen. Touchscreens not only allow switching operations to be carried out by touching the appropriate point, for example the stop bars or the taxiway sections, on the synthesized display that is formed, but also by clicking a mouse or by operating switches or keys at the edge or periphery of the monitor. As a result, all the switches, which until now have been arranged on separate panels or keyboards, are advantageously concentrated within the controller's field of view. This results in a corresponding increase in operational safety, with the capability to directly control and confirm the switching processes carried out.

To achieve the required concentration of data, all the data, including the analog radar data, are first digitized. Plot extraction is particularly advantageous in this regard, with the additional use of data fusion, including sensor correlation. All data are changed to a standard format before being output to the radar video or to a completely synthesized display.

To increase planning safety and to take account of emergencies, the system is preferably supplied with data relating to aircraft movements in the airspace further away. It is further possible for these distant movements, in addition to approach and departure positions, taxiway positions and parking area positions, to be determined by a global positioning system (GPS), particularly a differential GPS. In this context, the use of GPS improves safety, since it provides additional position information. However, because the GPS function is subject to some uncertainty, particularly in the terminal area, it is envisaged only for improving safety, i.e. as an additional function. The actual traffic management is carried out using reliable radar data and other ground sensors, backed up by visual observation by the controllers. These sensors may include optical sensors, e.g., for the docking area, and e.g., in the form of lasers or raster cameras.

Turning now to the docking system, safety can be improved if the position data supplied by the docking system are fed into the data fusion and sensor correlation, and vice versa. Safety is improved even further if this is done taking account of the parking position plans, by including them in the surface traffic plans.

BRIEF DESCRIPTION OF THE DRAWINGS

The invention and further advantageous refinements of the invention according to the features of the dependent claims are explained in more detail below with the aid of diagrammatic, exemplary embodiments in the drawing, in which:

DETAILED DESCRIPTION OF THE PREFERRED EMBODIMENTS

Figure 1:
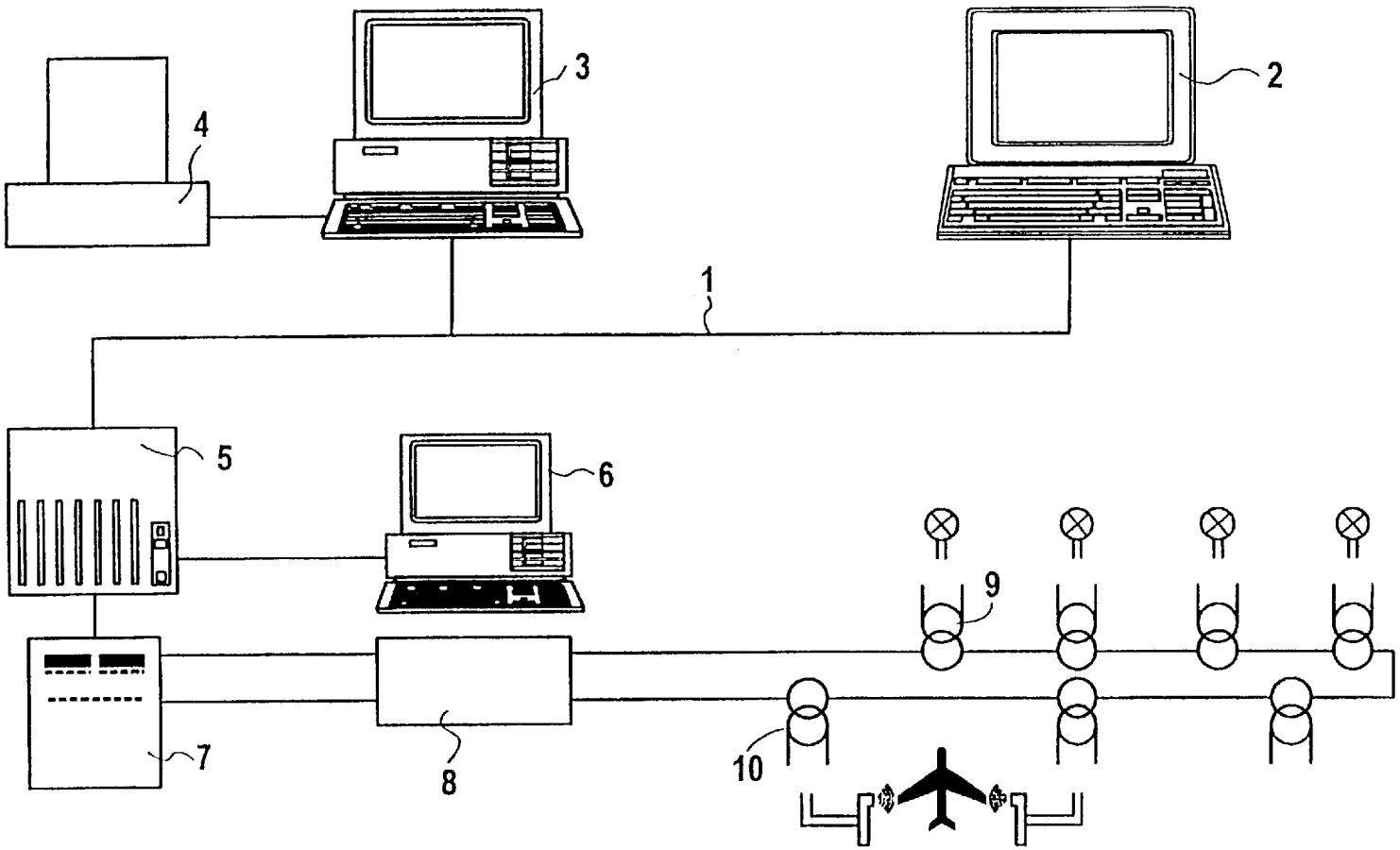
FIG. 1 shows a schematic illustration of conventional SMGCS components.

FIG. 1 is based on a figure from the above-mentioned document AP.01.810e. Reference numeral 1 denotes the airport LAN, and 2 a controller's station monitor, while 3 and 4 denote the monitor and the printer, respectively, for the service and maintenance computer. The monitor 2 either uses conventional monitor technology or is a flat panel screen, in particular a touchscreen. Numeral 5 denotes PLCs and 6 the BRITE PC which, according to the invention, is integrated in the ATC tower monitor. The software required to operate the BRITE II system is contained in the BRITE Master 8 and produces the desired switching states in the BRITE units 9. The BRITE units are further connected to sensors 10, which are integrated into the system in an appropriate, desired configuration. In the illustration, the BRITE units are connected in series, to ensure that their brightness levels are all the same. In the illustrated conventional art, there is no data link to the airport radar systems.

In contrast to this, the SMGCS design in accordance with the present invention has an integrated controller workstation, preferably based on X-Windows and an open architecture. In this case, a synthesized display is produced from the raw video (actual display video), together with maps, object data, conflict messages, flight plan data, stop bar data and lighting data.

This integration results in a sensor system representing a combination of various sensors, above all various radar systems. The sensor data are fused to ensure seamless monitoring.

Data processing for the inventive system is carried out using multisensor tracking and labeling, with the sensor data being correlated with flight plan data, lighting data and docking/gate-occupancy data. This is then used to control the airport traffic.

Figure 2:
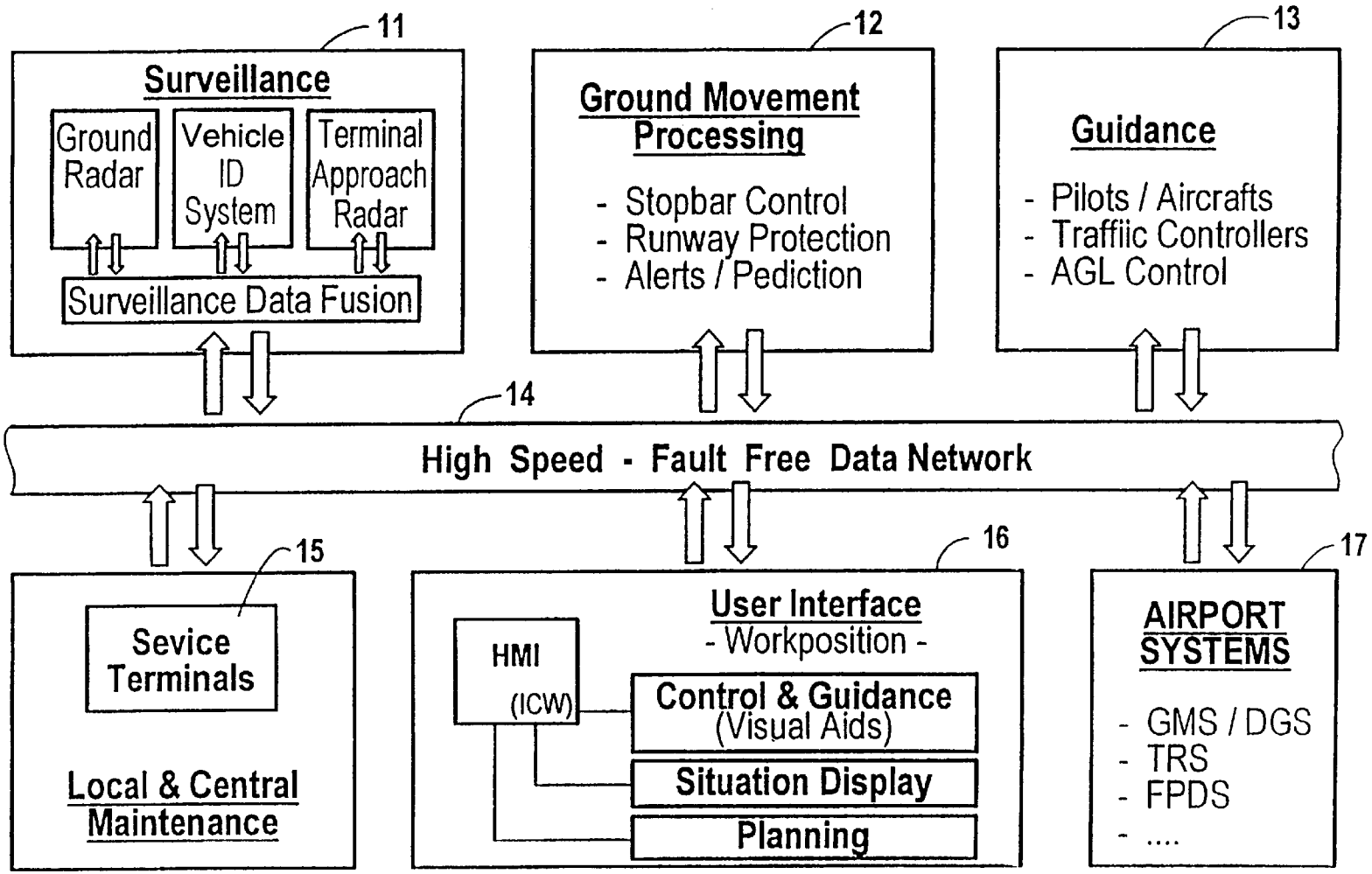
FIG. 2 shows a schematic illustration of the interaction between the individual SMGCS components according to the invention.

In FIG. 2, which illustrates an embodiment of the inventive system structure, 11 denotes a block containing sensor data for monitoring, 12 denotes the processes which are used for monitoring and 13 represents the reference point for the controller, the pilot, etc. Reference numeral 14 denotes a high-speed data network (Airport LAN) which is designed as a fault-free, fail-safe system. The system also receives information from the block 15, i.e., from peripheral services. The airport personnel carry out the monitoring operations illustrated in block 16, as well as making the inputs required to do this. Finally, block 17 shows the essential system components which are used.

Figure 3:
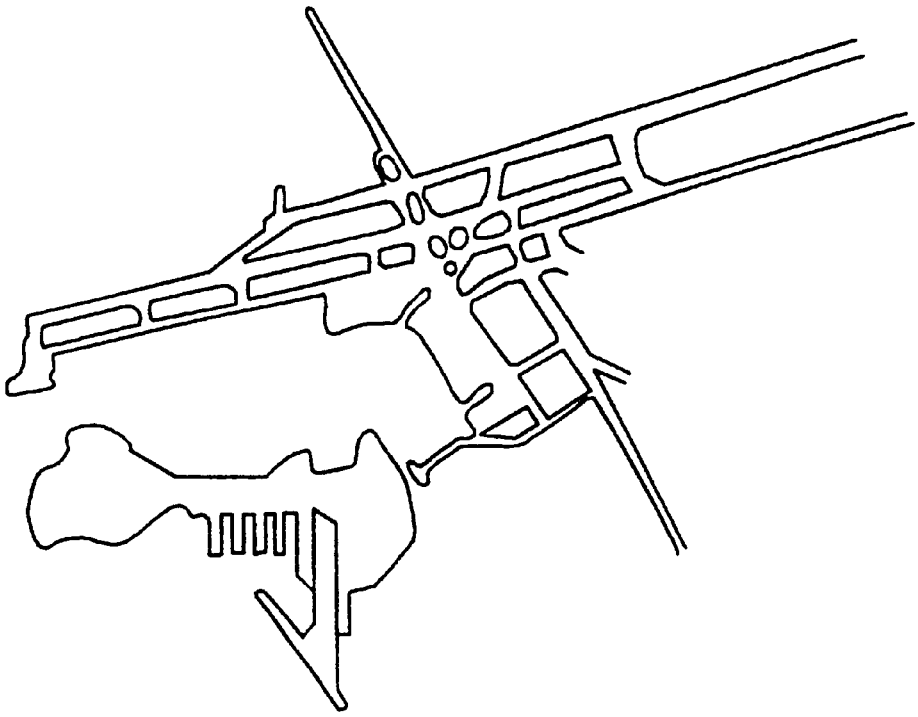
FIG. 3 shows a representation of an actual radar video.

FIG. 3 is self-explanatory and shows an actual radar video, which forms the basis of the sensor system used. The sensor system transmits data about the position and, optionally, about the speed, direction and identity number of all aircraft and vehicles. In addition, information is provided about stationary objects and their position relative to the indicated positions of the aircraft and the vehicles being tracked. The radar video is supplemented by data outputs from stationary sensors. This is particularly important for areas where radar shadowing occurs. The combination of all the sensors mentioned above provides complete information about the airport traffic.

Figure 4:
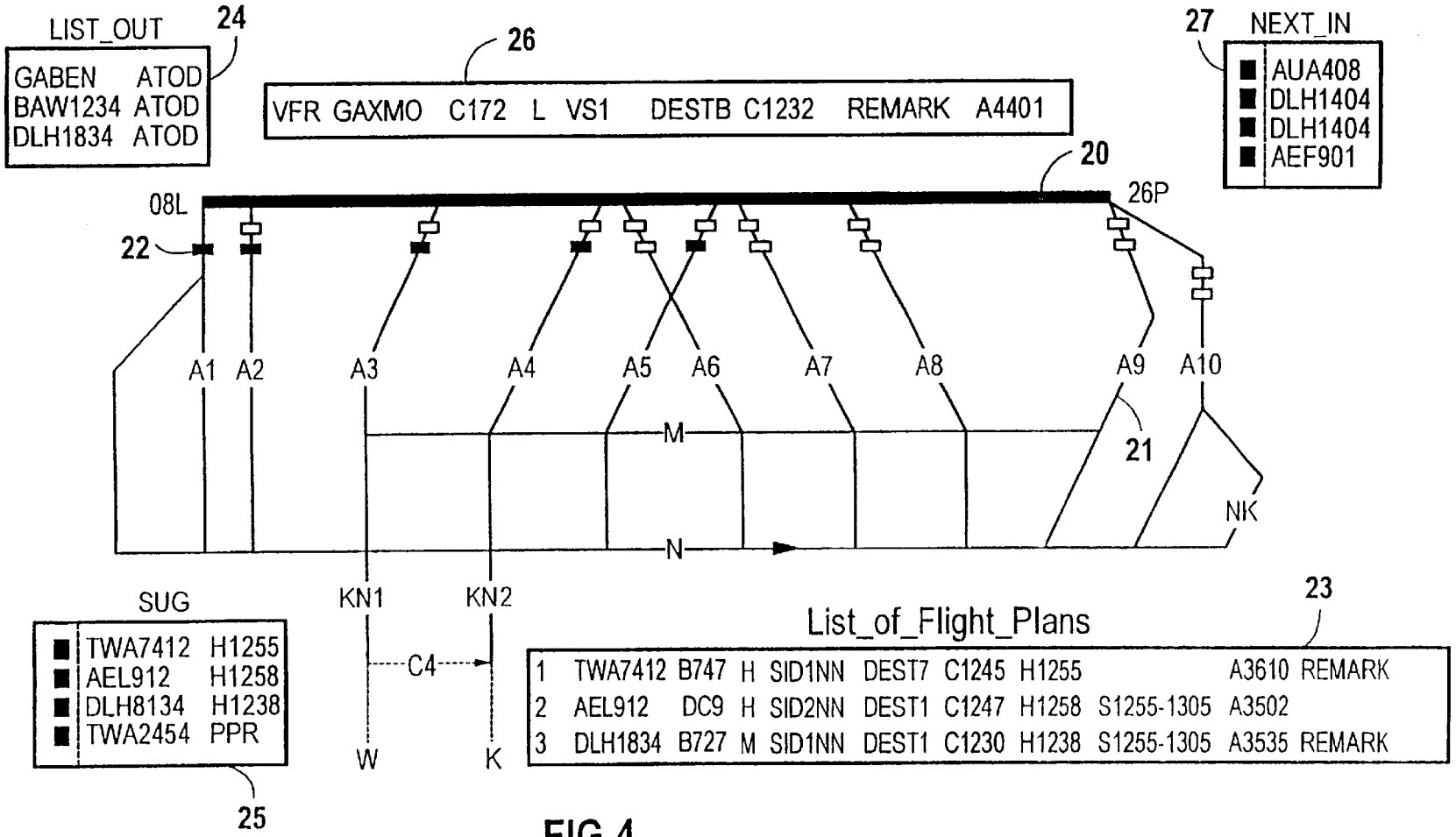
FIG. 4 shows a representation of a synthesized display with windows.

In FIG. 4, a runway, for example, is denoted by 20, while 21 denotes taxiways. Stop bars 22 or the like are located on the taxiways, as well as other lighting and information displays, although these are not shown, in order to avoid confusing the illustration. This portion of FIG. 4 shows an implemented synthesized display, once again to this extent representing the conventional art. According to the invention, the new synthesized video is designed to be more detailed. Reference numeral 23 denotes a window display of the flight plan, while 24, 25, 26 and 27 denote further flight plan and assignment windows. If a large flat screen is employed, these and other details can be displayed with appropriate sizes and in a clear arrangement. A flat screen is recommended in order to provide, for example, a low physical height, and to allow other systems to be installed, and/or to create space for other systems.

Figure 5:
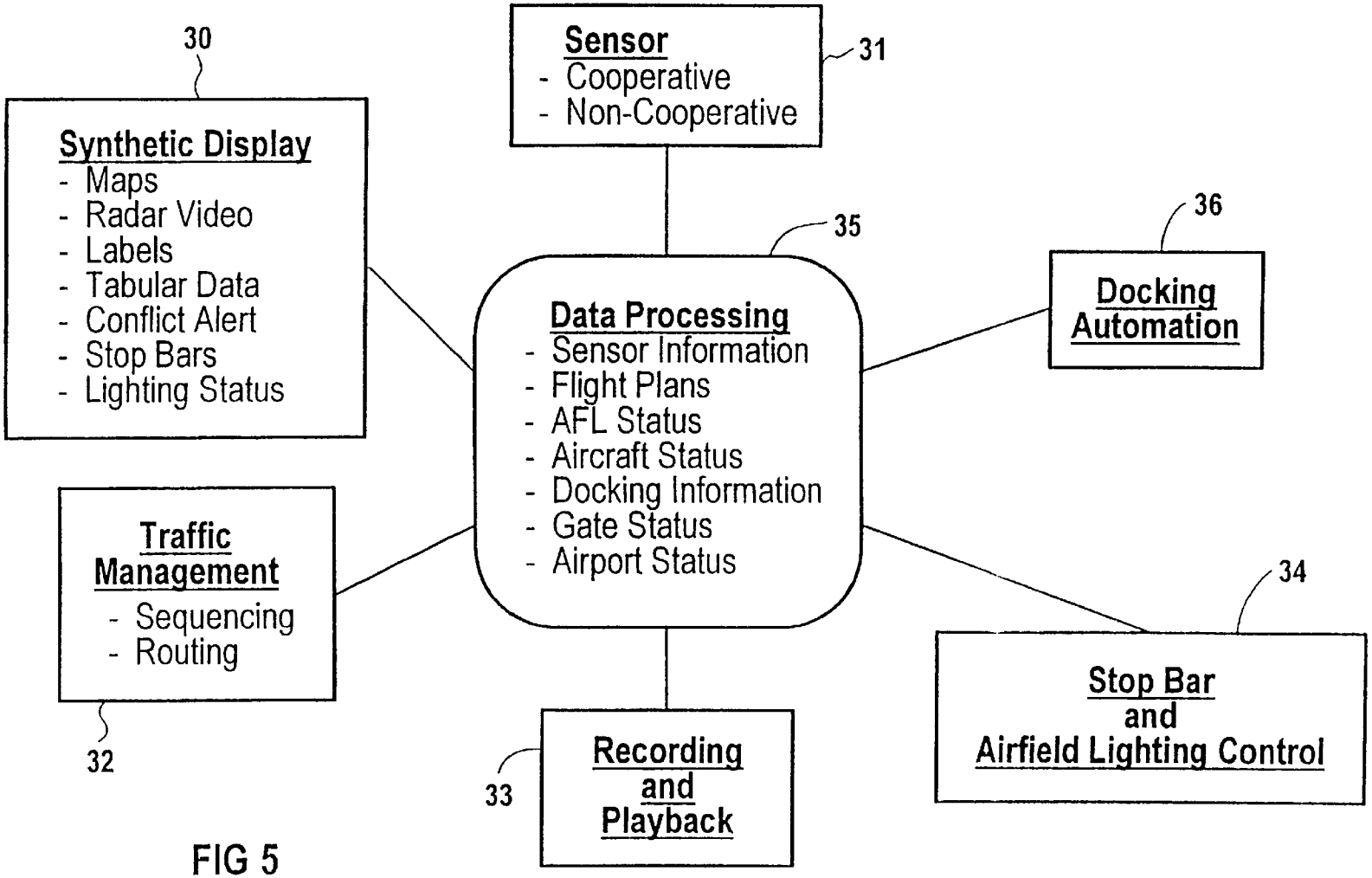
FIG. 5 shows an overview of the predominant information transmitted.

In FIG. 5, the predominant categories of information contained in the synthesized display are listed in the block 30. The block 31 shows the two types of sensors employed, which may operate on very different bases. Most important are the sensors which interact and at the same time verify aircraft identification. The block 32 shows the basic principles of the movement guidance and control system, and 33 shows the auxiliary functions, which become important particularly when special situations arise. Block 34 indicates the components which are actually used to control aircraft on the runway and on the taxiways as well as in the ramp area, while the block 36 shows the docking automation system, which may be implemented using a wide range of sensors (lasers, raster cameras, microwave receivers, D-GPS etc.). Finally, the block 35 indicates the integration of the widely varying data which converge in the system.

It is apparent that a system according to the invention is realized even if not all the individual components described here are integrated into the system, certain components instead being operated as stand-alone systems. Even systems in which individual components, such as automatic docking systems, are left out completely fall within the scope of the invention. Such a system might be implemented, for example, at relatively small airports that have only a few parking positions. Even such systems can make use of the present invention if based on the use of one workstation, with the option for dividing the control tasks, to handle all the essential data which provide information about the positions and movements of aircraft and, possibly, vehicles.

The above description of the preferred embodiments has been given by way of example. From the disclosure given, those skilled in the art will not only understand the present invention and its intended advantages, but will also find apparent various changes and modifications to the features disclosed. It is sought, therefore, to cover all such changes and modifications as fall within the spirit and scope of the invention, as defined by the appended claims, and equivalents thereof.

What is claimed is:

1. An airport surface movement guidance and control system comprising:

a radar arrangement that comprises at least one radar and that detects positions and movements of aircraft in a period extending from being airborne to being in a stationary, parked position;

a plurality of ground traffic signal devices for directing the aircraft, wherein the ground traffic signal devices comprise signal devices on runways, signal devices on taxiways, signal devices on an apron, and parking position signal devices; and wherein the ground traffic signal devices comprise interfaces for outputting signal states of the traffic signal devices and for receiving signal state commands;

a processing system for integrating data detected by said radar arrangement and the signal states indicated by said interfaces;

an integrated graphical display system provided as an output for the integrated data on at least one monitor of at least one airport tower controller, and comprising a radar video of the positions and movements of the aircraft on the airport surface and in airspace of the airport and a video display of the signal states of said ground traffic signal devices; and an input configured for the controller to input the signal state commands for said plurality of ground traffic signal devices.

2. The airport surface movement guidance and control system as claimed in claim 1, further comprising at least one detector that detects positions and movements of ground vehicles of the airport; and wherein said processing system further integrates data detected by said detector, and said integrated graphical display system further comprises a video display of the positions and movements of the ground vehicles.

3. The airport surface movement guidance and control system as claimed in claim 2, wherein said at least one detector that detects the positions and movements of the ground vehicles comprises a communications unit including at least one of a transponder interrogator, a receiver for transponder squitters, an identification tag detector, and a wireless receiver.

4. The airport surface movement guidance and control system as claimed in claim 2, wherein said communications unit further comprises a transmitter for transmitting instructions to the ground vehicles.

5. The airport surface movement guidance and control system as claimed in claim 2, wherein said integrated graphical display system displays airport traffic routes, the positions of the aircraft and the ground vehicles and taxiing directions by means of at least a radar video.

6. The airport surface movement guidance and control system as claimed in claim 5, wherein said integrated graphical display system further displays speeds of the aircraft and the ground vehicles.

7. The airport surface movement guidance and control system as claimed in claim 5, wherein said integrated graphical display system is displayed on a single monitor.

8. The airport surface movement guidance and control system as claimed in claim 7, wherein the-single monitor further displays windows with status displays and handover displays.

9. The airport surface movement guidance and control system as claimed in claim 8, wherein the status displays and handover displays are displayed in line form and include acknowledgement lines.

10. The airport surface movement guidance and control system as claimed in claim 2, wherein said integrated graphical display system displays airport traffic routes, the positions of the aircraft and the ground vehicles and taxiing directions by means of a synthesized display.

11. The airport surface movement guidance and control system as claimed in claim 10, wherein:

said plurality of ground traffic signal devices comprises signal devices on take-off and landing runways, signal devices on an apron and taxiways, and parking position signal devices; and said integrated graphical display system displays the signal states of said plurality of ground traffic signal devices on the synthesized display.

12. The airport surface movement guidance and control system as claimed in claim 10, wherein said integrated graphical display system is displayed on a single monitor.

13. The airport surface movement guidance and control system as claimed in claim 12, wherein the single monitor further displays windows with status displays and handover displays.

14. The airport surface movement guidance and control system as claimed in claim 13, wherein the status displays and handover displays are displayed in line form and include acknowledgement lines.

15. The airport surface movement guidance and control system as claimed in claim 1, wherein the video display of the ground traffic signal states is in character or numeric form.

16. The airport surface movement guidance and control system as claimed in claim 1, wherein said plurality of ground traffic signal devices comprises stop bars and docking instruction notices.

17. The airport surface movement guidance and control system as claimed in claim 1, wherein the positions and movements of the aircraft detected by said radar arrangement include airborne positions and movements of the aircraft during landing and takeoff.

18. The airport surface movement guidance and control system as claimed in claim 17, wherein said radar arrangement comprises a primary radar for detecting the positions of the aircraft on airside grounds of the airport and a secondary radar for detecting the positions of the aircraft during the landing and the takeoff.

19. The airport surface movement guidance and control system as claimed in claim 18, wherein said secondary radar detects the positions of the aircraft during the landing and the takeoff through transponders.

20. The airport surface movement guidance and control system as claimed in claim 1, wherein said radar arrangement comprises a primary radar for detecting the positions of the aircraft on airside grounds of the airport.

21. The airport surface movement guidance and control system as claimed in claim 20, wherein:

said processing system identifies the detected aircraft in accordance with stored data sources and the positions of the aircraft detected by said primary radar; and said display system displays the identification of the detected aircraft.

22. The airport surface movement guidance and control system as claimed in claim 1, wherein said processing system comprises a multilateration system that performs multilateration of signal arrival times of transponder squitters for detecting a current exact position of the aircraft and for identifying the aircraft.

23. The airport surface movement guidance and control system as claimed in claim 1, wherein:

said processing system comprises a taxiing movement planning component for generating a collision-free taxiing traffic pattern for the aircraft and other surface movement; and wherein the taxiing movement planning component includes data for aircraft landing direction and required safety separations, as a function of weather category.

24. The airport surface movement guidance and control system as claimed in claim 1, wherein:

said integrated graphical display system displays taxiway lighting sections, stop bars and all further signaling devices utilized to control surface movement of the aircraft; and said integrated graphical display system further displays a current switching state of the taxiway lighting sections, the stop bars and the further signaling devices.

25. The airport surface movement guidance and control system as claimed in claim 1, wherein said processing system partitions the data and signal states on the basis of a controller responsibility assessment and outputs the partitioned data and signal states to the integrated graphical display system in accordance with the assessment.

26. The airport surface movement guidance and control system as claimed in claim 25, wherein said processing system assesses a current extent of airport traffic, and partitions the data and signal states in accordance with the airport traffic assessment.

27. The airport surface movement guidance and control system as claimed in claim 26, further comprising a plurality of display monitors; and wherein, in accordance with the airport traffic assessment, the data and signal states are partitioned and displayed selectively on one or more of the display monitors.

28. The airport surface movement guidance and control system as claimed in claim 1, wherein:

said processing system directs the data and signal states on the basis of a controller responsibility assessment;

said processing system causes said integrated graphical display system to display a handover display and an acknowledgement display on at least one monitor;

said input is further configured for a controller at least one monitor to input activation commands for activating display of the handover display and the acknowledgment display; and said processing system performs the controller responsibility assessment in accordance with the activation commands.

29. The airport surface movement guidance and control system as claimed in claim 1, wherein:

said processing system directs the data and signal states on the basis of a controller responsibility assessment;

said processing system partitions the data and signal states at least into landing and takeoff control area information, runway and taxiway control area information, and apron control area information in accordance with a location assessment;

said processing system causes said integrated graphical display system to hand over display of the data and signal states from one display to another display in accordance with the location assessment.

30. The airport surface movement guidance and control system as claimed in claim 1, wherein:

said processing system integrates the radar arrangement data, status information for at least one taxiway, and the signal states of landing and take-off runway lights and further sensor components into processed data having a standard format; and said integrated graphical display system displays the processed data in at least one of a radar video and fully synthesized display.

31. The airport surface movement guidance and control system as claimed in claim 30, wherein:

the radar arrangement data are integrated with plot-extraction;

the radar arrangement data, the status information and the signal states are integrated through data fusion and sensor correlation; and the standard format for the processed data is a fully digitized format.

32. The airport surface movement guidance and control system as claimed in claim 1, further comprising a flat panel display having a screen diagonal exceeding 19 inches for displaying the radar video and the video display.

33. The airport surface movement guidance and control system as claimed in claim 32, wherein said flat panel display comprises a touchscreen provided with switching elements, said switching elements forming at least a part of said input for inputting the signal state commands.

34. The airport surface movement guidance and control system as claimed in claim 1, further comprising a detection system for outputting data relating to airborne aircraft movements to said processing system.

35. The airport surface movement guidance and control system as claimed in claim 34, wherein said detection system comprises a differential global positioning system.

36. The airport surface movement guidance and control system as claimed in claim 1, further comprising a maintenance computer with a monitor for processing and displaying required maintenance and repair tasks and light failures.

37. The airport surface movement guidance and control system as claimed in claim 1, wherein said plurality of ground traffic signal devices comprises lights of an airport lighting system, said lights comprising EPROMS that enable the signal state commands to address said lights individually.

38. The airport surface movement guidance and control system as claimed in claim 1, further comprising an airport data transmission system for providing communication paths between said processing system, said radar arrangement, said plurality of ground traffic signal devices, said integral graphical display system, and said input.

39. The airport surface movement guidance and control system as claimed in claim 38, wherein said airport data transmission system comprises at least one of glass-fiber transmission lines, coaxial cables and twisted pair cables, and is of redundant design.

40. The airport surface movement guidance and control system as claimed in claim 1, further comprising an automatic docking system including an optical detection system that detects the positions of the aircraft and outputs position detection signals; and wherein said processing system integrates the position detection signals with the data and the signal states.

41. The airport surface movement guidance and control system as claimed in claim 40, wherein said optical detection system comprises at least one of raster cameras, laser ranging devices and transponder identification units.

42. The airport surface movement guidance and control system as claimed in claim 40, wherein said processing system integrates the position detection signals with the data and the signal states through data fusion and sensor correlation into processed data having a standard format.

43. The airport surface movement guidance and control system as claimed in claim 40, wherein said processing system generates parking position selection, occupancy and status messages for the aircraft on the basis of stored flight plan data, the status messages being output to said docking system and to said integrated graphical display system.

* * * * *